US009636911B2

(12) United States Patent
Kurihara et al.

(10) Patent No.: US 9,636,911 B2
(45) Date of Patent: May 2, 2017

(54) INKJET RECORDING DEVICE

(71) Applicant: Hitachi Industrial Equipment Systems Co., Ltd., Chiyoda-ku, Tokyo (JP)

(72) Inventors: Hiroko Kurihara, Tokyo (JP); Takashi Kawano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 15/108,893

(22) PCT Filed: Dec. 26, 2014

(86) PCT No.: PCT/JP2014/084639

§ 371 (c)(1),
(2) Date: Jun. 29, 2016

(87) PCT Pub. No.: WO2015/105031

PCT Pub. Date: Jul. 16, 2015

(65) Prior Publication Data

US 2016/0325545 A1 Nov. 10, 2016

(30) Foreign Application Priority Data

Jan. 8, 2014 (JP) ..... 2014-001637

(51) Int. Cl.
*B41J 2/08* (2006.01)
*B41J 2/12* (2006.01)
(Continued)

(52) U.S. Cl.
CPC ..... *B41J 2/04555* (2013.01); *B41J 2/02* (2013.01); *B41J 2/04586* (2013.01); *B41J 2/08* (2013.01);
(Continued)

(58) Field of Classification Search
CPC ..... B41J 2/175; B41J 2/02; B41J 2/07; B41J 2/08; B41J 2/085; B41J 2/09; B41J 2/04555; B41J 2/04586; B41J 2002/1853
See application file for complete search history.

(56) References Cited

U.S. PATENT DOCUMENTS 4,310,846 A 1/1982 Horike
4,442,440 A * 4/1984 Elchinger ..... B41J 2/185 347/74
(Continued)

FOREIGN PATENT DOCUMENTS

EP 0 645 245 A1 7/1994
JP 55-92984 A 7/1980
(Continued)

OTHER PUBLICATIONS

International Search Report (PCT/ISA/210) issued in PCT Application No. PCT/JP2014/084639 dated Mar. 24, 2015 with English translation (5 pages).
(Continued)

*Primary Examiner* — Anh T. N. Vo
(74) *Attorney, Agent, or Firm* — Crowell & Moring LLP

(57) ABSTRACT

The purpose of the present invention is to suppress variance in the print quality of an inkjet recording device. In order to solve the above problem, the present invention is an inkjet recording device of a charge control type equipped with two or more nozzles which are disposed side by side in a print head, the inkjet recording device being characterized by the following: having a control unit for performing print control independently for each of a plurality of printing configurations; the control unit having an input unit whereby current values of print elements of each of the printing configurations can be periodically checked, and having an output unit whereby the print elements during a subsequent print can be modified; and in that the control unit further adjusts each of
(Continued)

the nozzles for every print so as to cause the "charging voltage", "deflecting voltage", and "ink pressure" of the subsequent print to approach a reference value.

4 Claims, 14 Drawing Sheets

(51) Int. Cl.
*B41J 2/045* (2006.01)
*B41J 2/02* (2006.01)
*B41J 2/175* (2006.01)
*B41J 2/185* (2006.01)

(52) U.S. Cl.
CPC ..... *B41J 2/12* (2013.01); *B41J 2/175* (2013.01); *B41J 2002/022* (2013.01); *B41J 2002/1853* (2013.01)

(56) References Cited

U.S. PATENT DOCUMENTS 4,734,705 A * 3/1988 Rezanka ..... B41J 2/12 347/75
5,418,557 A * 5/1995 Pullen ..... B41J 2/115 347/7
5,838,342 A 11/1998 Takahashi et al.
6,386,673 B1 5/2002 Takahashi et al.
8,333,463 B2 * 12/2012 Nagamine ..... B41J 2/03 347/21
9,102,157 B2 8/2015 Prothon et al.
2005/0280676 A1 12/2005 Rybicki et al.

FOREIGN PATENT DOCUMENTS

JP 5-193139 8/1993
JP 6-91998 A 4/1994
JP 2003-191473 A 7/2003
JP 2008-502506 A 1/2008
JP 2010-228402 A 10/2010
JP 2012-66422 A 4/2012
JP 2013-515625 A 5/2013
JP 2015-13385 A 1/2015

OTHER PUBLICATIONS

Japanese-language Written Opinion (PCT/ISA/237) issued in PCT Application No. PCT/JP2014/084639 dated Mar. 24, 2015 (5 pages).

* cited by examiner

INKJET RECORDING DEVICE

TECHNICAL FIELD

The present invention relates to a charge-control-type inkjet recording device and an inkjet recording device capable of adjusting vertical landing positions of ink particles and an entire print height at the time of printing by including two or more nozzles in a print head and having a function of performing fine adjustment on a charging voltage, a deflecting voltage, and an ink pressure influencing the print for each nozzle in the case of performing the print by simultaneously manipulating the nozzles.

BACKGROUND ART

As a background art of the present technique, there are Patent Document 1 (JP 2010-228402 A) and Patent Document 2 (JP 2012-66422 A). Patent Document 1 discloses control of correcting a deviation in writing position to start printing in an inkjet recording device where a plurality of nozzles are arranged vertically with respect to a print material. In addition, Patent Document 2 discloses a configuration having a flow-passage control function in order to improve maintenance of ink particles ejected from nozzles in an inkjet recording device where a plurality of the nozzles are arranged horizontally with respect to a print material.

Unlike the techniques disclosed in Patent Documents 1 and 2, the present invention is a technique of improving a print quality of the printing performed by a plurality of nozzles.

CITATION LIST

Patent Document

Patent Document 1: JP 2010-228402 A
Patent Document 2: JP 2012-66422 A

SUMMARY OF THE INVENTION

Problems to be Solved by the Invention

Among charge control type inkjet recording devices, in a device having a configuration that two or more nozzles are arranged side by side within a print head (hereinafter, referred to as an inkjet recording device equipped with multi-nozzles), in a case where ink particles are output from the nozzles vertically with respect to the print material on a transport line, characters are formed by setting the output of the ink particles from the nozzles to the vertical direction and setting a transport-line speed to the horizontal direction. Therefore, by maintaining an output result of the ink particles constant, vertical landing positions and an entire print height are adjusted.

As elements influencing the print result, there are a charging voltage as a charge amount which is applied at the time of forming the ink particles, a deflecting voltage which determines a deflection width at the time when the ink particles are ejected from the print head, an ink pressure necessary for the ink to approach from an ink container to the nozzles, a control board which performs control of nozzle operations, and the like.

Since these elements exist individually for every nozzle, although a changed amount thereof is very infinitesimal, due to an individual variation between nozzles, the changed amount appears in a visible form as an irregularity in the print result. Therefore, the vertical landing positions of the ink particles and the entire print height are changed, so that the print quality is deteriorated. Particularly, in the inkjet recording device equipped with the multi-nozzles, these elements greatly influence the printing of print contents required for continuity or accuracy in the print result such as a two-dimensional barcode or a logo.

The present invention is to suppress a variation in print quality of an inkjet recording device.

Solution to Problems

In order to solve the above-described problem, for example, configurations disclosed in Claims are employed. The present invention includes a plurality of means for solving the above-described problem. As an example, there is provided an inkjet recording device having a plurality of print configurations including nozzles which eject ink to form ink particles, charging electrodes which apply charging voltages to the ink particles to charge the ink particles, deflecting electrodes which deflect the charged ink particles, and a gutter which recovers the ink particles which are not used for printing, the inkjet recording device including a control unit which independently performs print control on the plurality of print configurations, wherein the control unit includes an input unit which can periodically check current values of print elements of each of the print configurations and an output unit which can change print elements of a next print time, and wherein the control unit adjusts each of the nozzles for each print so that a charging voltage, a deflecting voltage, and an ink pressure of a next print time are close to reference values. In addition, the current value denotes a setting value in a print condition in the state that printing is currently performed, and the value of the next print, time denotes a setting value a print condition after the printing is currently performed.

Effect of the Invention

According to the present invention, it is possible to suppress a variance in print quality of an inkjet recording device.

MODE FOR CARRYING OUT THE INVENTION

Hereinafter, embodiments of the present invention will be described with reference to the drawings. Herein, a case where a twin-nozzle-equipped inkjet recording device where two nozzles are disposed in a print head is used and one print content is printed by simultaneously manipulating these nozzles will be described.

A configuration of an embodiment of the present invention is described with reference to FIGS. 1A to 1E.

Figure 1A:
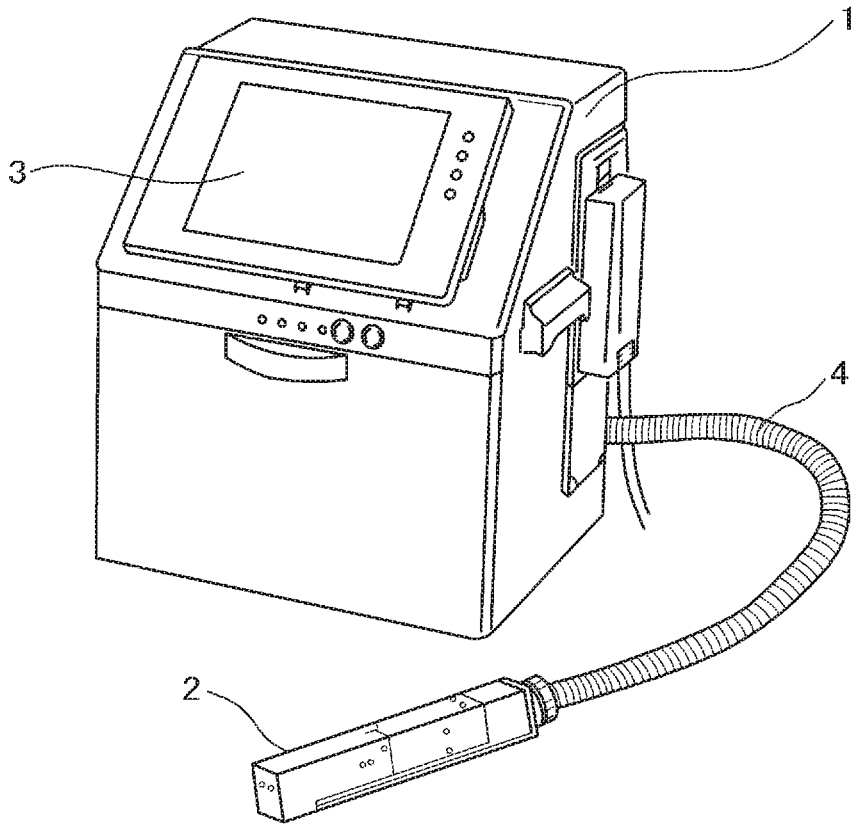
FIG. 1A illustrates an outer appearance perspective diagram of an inkjet recording device having twin nozzles according to the present invention.
Figure 1B:
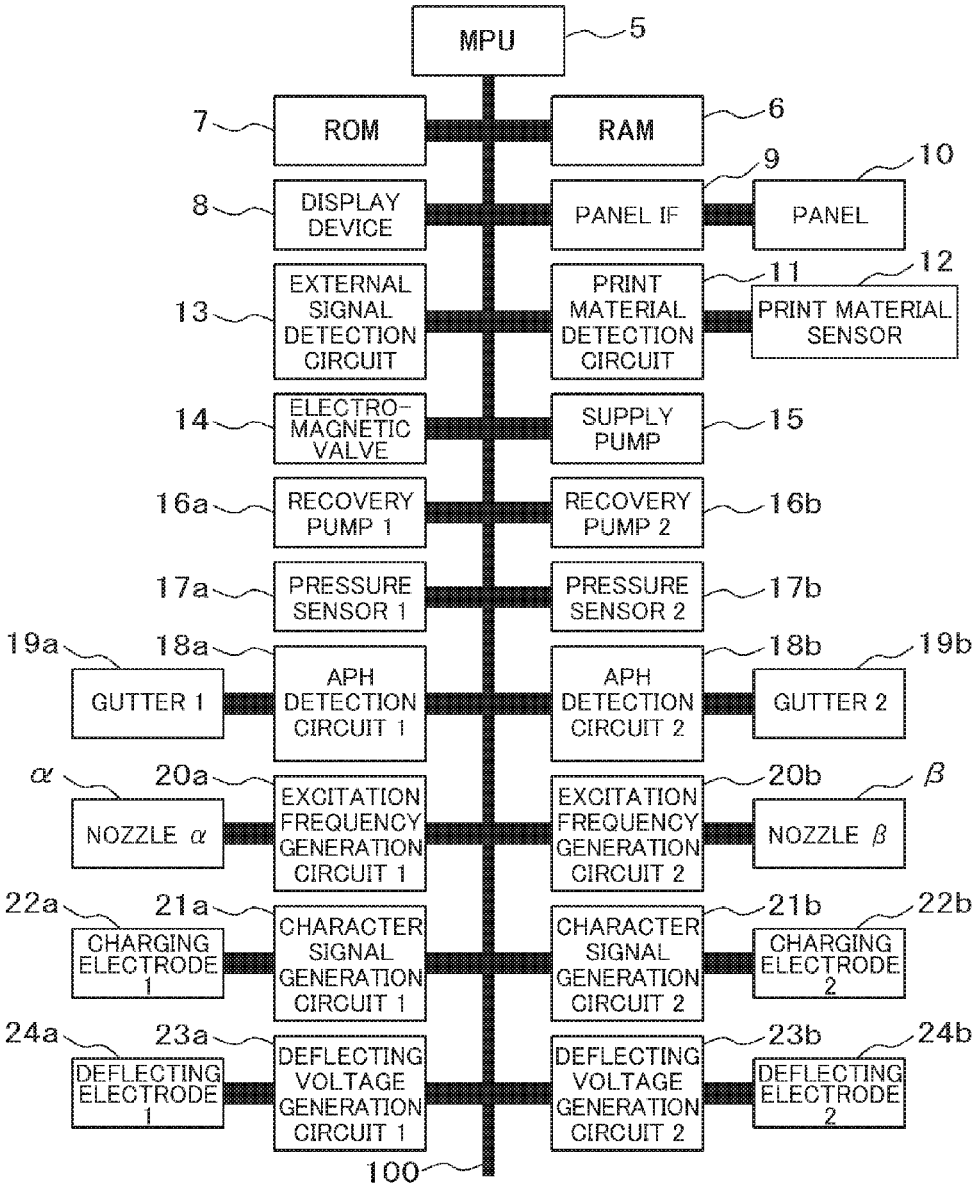
FIG. 1B illustrates a control block diagram of the inkjet recording device of FIG. 1A.
Figure 1C:
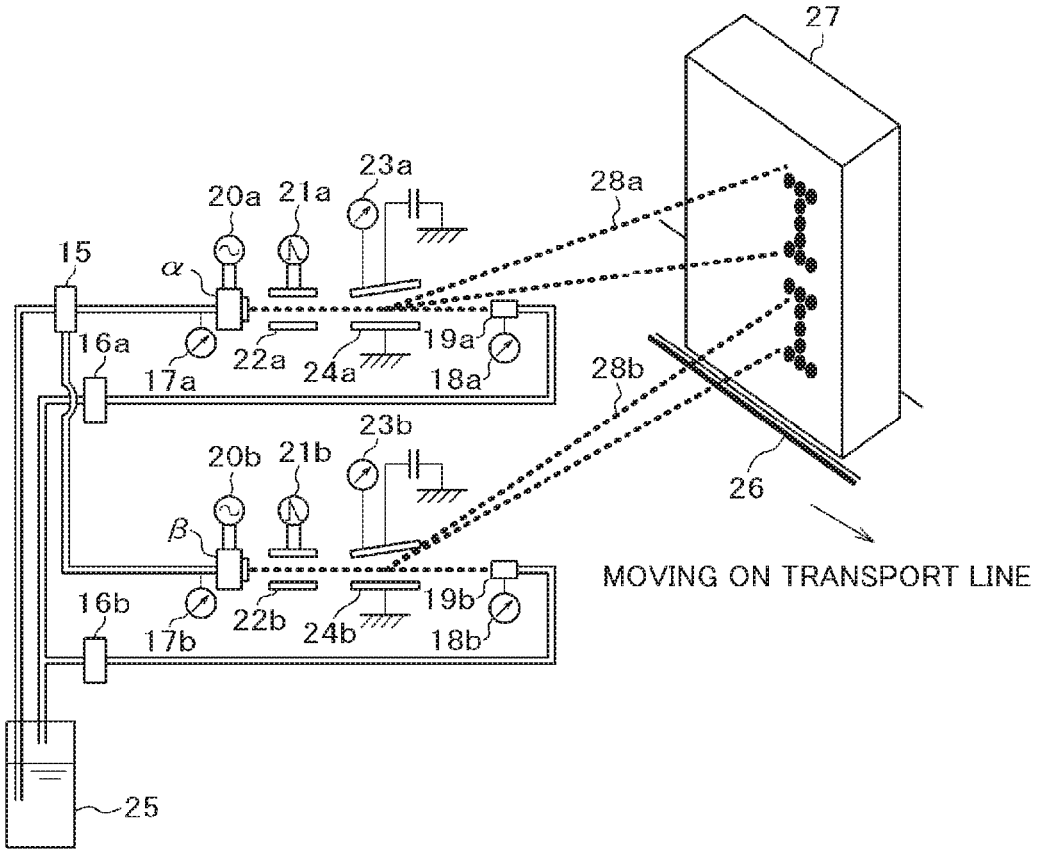
FIG. 1C illustrates a configuration diagram explaining a print operation in a case where the twin nozzles of the inkjet recording device are arranged in the vertical direction.
Figure 1D:
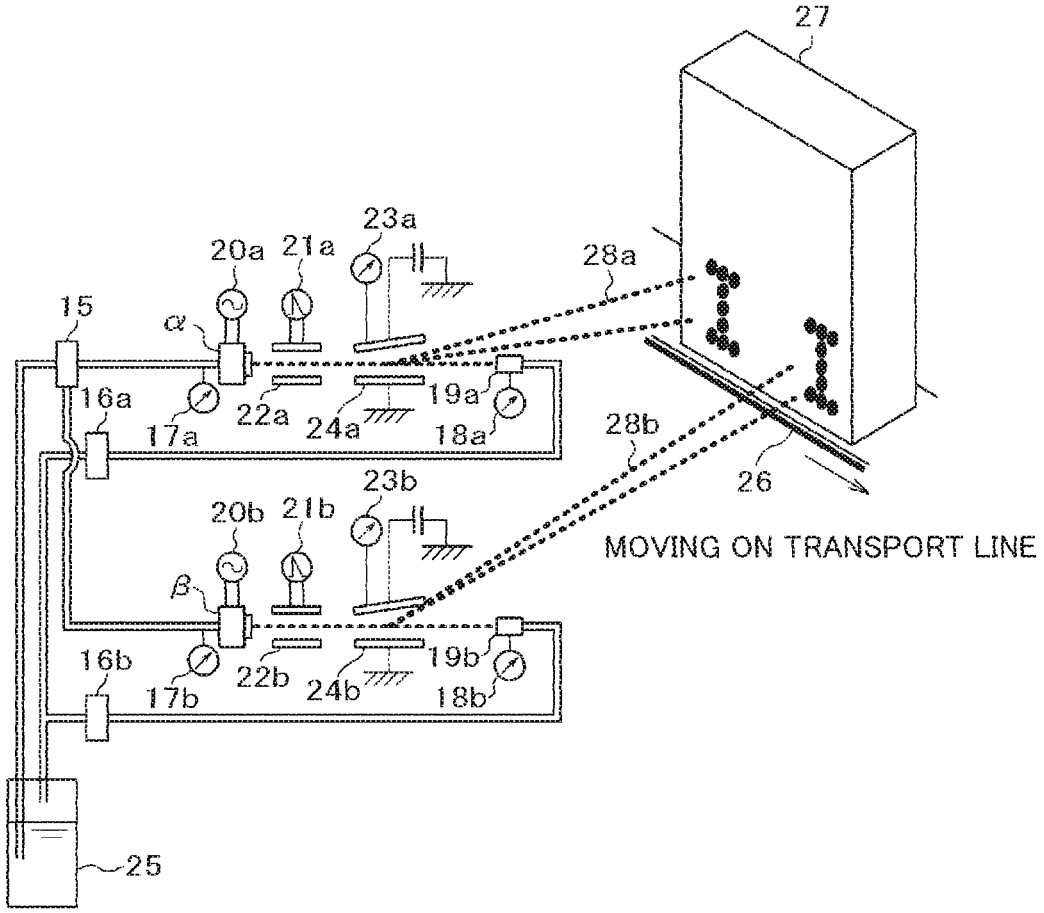
FIG. 1D illustrates a configuration diagram for explaining a print operation in a case where the twin nozzles of the inkjet recording device are arranged in the horizontal direction.
Figure 1E:
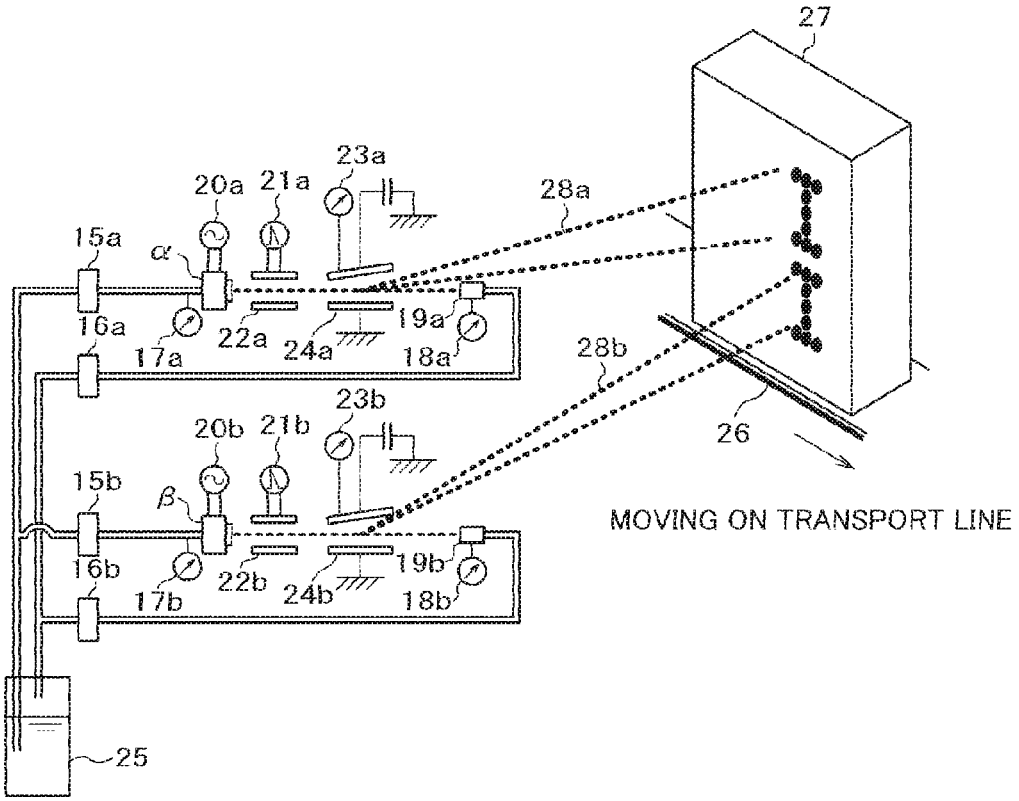
FIG. 1E illustrates a configuration diagram for explaining a print operation in a case where the twin nozzles of the inkjet recording device are arranged in the vertical direction and two supply pumps are arranged.

FIG. 1A illustrates an outer appearance perspective diagram of an inkjet recording device having twin nozzles, and FIG. 1B illustrates a system block diagram of an entire configuration of the inkjet recording device illustrated in FIG. 1A. In addition, FIG. 1C illustrates a configuration diagram explaining a print operation at the time of arranging the twin nozzles of the inkjet recording device in a vertical direction, FIG. 1D illustrates a configuration diagram explaining a print operation at the time of arranging the twin nozzles of the inkjet recording device in a horizontal direction, and FIG. 1E illustrates a configuration diagram explaining a print operation at the time of arranging the twin nozzles of the inkjet recording device in the vertical direction and arranging two supply pumps.

In the outer appearance perspective diagram of the inkjet recording device of FIG. 1A, the inkjet recording device main body 1 is configured to include a print head 2 equipped with twin nozzles, a display device 3 disposed in an upper portion of a front surface of the device main body, and a conduit 4 delivering and recovering ink and the like to and from the device main body. The inkjet recording device has a configuration where a panel 3 is disposed in the inkjet recording device main body 1, a print head 2 is provided outside and the device main body 1 and the print head 2 are connected by the conduit 4.

Next, a system block diagram of the entire configuration of the inkjet recording device illustrated in FIG. 1A is illustrated in FIG. 1B. In the inkjet recording device, an MPU which controls the entire inkjet recording device is connected to a RAM (random access memory) 6 which temporarily records data in the inkjet recording device, a ROM (read only memory) 7 which records programs and the like in advance, a display device 8 which displays information of print contents, or the like, a panel 10 which is connected to a panel IF (interface) 9 to input print information or to input print data for fine adjustment, a print material detection circuit 11 which is connected to a print material sensor 12 which detects a print material, a supply pump 15 which supplies ink, a recovery pump 16*a* for recovering ink from a first gutter 19*a*, a recovery pump 16*b* for recovering ink from a second gutter 19*b*, a pressure sensor 17*a* which measures a pressure of a pre stage of a nozzle α, a pressure sensor 17*b* which measures a pressure of a pre-stage of a nozzle β, APH (automatic phase) detection circuits 18*a* and 18*b* which detect a charge timing so as to charge ink particles with a charging electrode at a very appropriate timing, the first gutter 19*a*, the second gutter 19*b*, an excitation frequency generation circuit 20*a* which applies an excitation frequency to the nozzle α in order to produce ink particles, an excitation frequency generation circuit 20*b* which applies an excitation frequency to the nozzle β in order to produce ink particles, the nozzles α and β, character signal generation circuits 21*a* and 21*b* which generate character signals to be printed on the print material, charging electrodes 22*a* and 22*b* which charge the ink particles, deflecting voltage generation circuits 23*a* and 23*b*, which apply deflecting voltages to the deflecting electrodes, and the deflecting electrodes 24*a* and 24*b*, and the like via a bus 100 to control these components.

The ROM 7 stores a program for controlling the inkjet recording device, and the MPU 5 controls each component based on the program. In addition, the panel 10 is configured in a touch panel manner, so that data can be input on a screen, and the input data are stored in the RAM 6.

Next, print operations in the inkjet recording device when two nozzles α and β perform print on a print material 27 as a product located on a transport line 26 will be described with reference to FIG. 1C.

FIG. 1C illustrates a configuration of an inkjet recording device where two nozzles α and β are arranged side by side in the vertical direction and a single ink supply pump and two recovery pumps are arranged.

In the control of the print operation in FIG. 1C, at the time of ink supply from the ink container 25 to the nozzles, ink is supplied to the nozzle α and the nozzle β by the single supply pump 15; and at the time of ink recovery from the nozzles to the ink container 25, the ink of the nozzle α and the ink of the nozzle β are recovered by the recovery pump 16*a*, and the recovery pump 16*b*, respectively. In this case, it is assumed that an ink pressure loss at the time of ink supply to the nozzle α and the nozzle β is zero.

First, a position of the print material 27 as a product is detected by the print material sensor 12. Next, when the ink supplied from the ink container 25 by the supply pump 15 passes through the respective nozzles α and β, the nozzles α and β are excited by the excitation frequency generation circuits 20*a* and 20*b* to form ink particles 28*a* and 28*b*, charging voltages are generated by the character signal generation circuits 21*a* and 21*h* according to print data on the RAM 6, and the ink particles are charged by the charging electrodes 22*a* and 22*b*. The charged ink particles 28*a* and 28*b* pass through the deflecting electrodes 24*a* and 24*b* applied with the deflecting voltages output from the deflecting voltage generation circuits 23*a* and 23*b* to be deflected, and the ink particles form print dots on the print material 27 as a product, so that printing is performed. Non-charged ink particles 28*a* and 28*b* are not used for printing but recovered through the gutters 19*a* and 19*b* by the recovery pumps 16*a* and 16*b* to be returned to the ink container 25.

Herein, with respect to the ink pressure, the charging voltage, and the deflecting voltage used for producing the print data, the current values thereof can be easily acquired, and the current values can also be displayed on the display device 8. As the methods of acquiring the values, the ink pressure can be directly acquired from the pressure sensors 17*a* and 17*b* in real-time, and the deflecting voltage can be directly acquired from the deflecting voltage generation circuits 23*a* and 23*b* in real-time. With respect to the charging voltage, when printing is not performed, a charging voltage check operation is periodically performed, and during the check operation, the charging voltage can be acquired from the APH (automatic phase) detection circuits 18*a* and 18*b* connected to the gutters 19*a* and 19*b* not in real-time but indirectly.

In addition, at the time of changing settings of the print data or various print conditions in the printing performing, the settings are changed by performing analysis by the MPU 5 using a program in the ROM 7 based on information acquired from an input unit such as the panel 10 or an external signal detection device 13 or data in the RAM 6. After the settings are changed, the changed values are stored in the RAM 6. After the settings are changed, the current settings are displayed on the display device 8 or the external signal detection device 1.

Next, a print operation of an inkjet recording device where two nozzles α and β are arranged side by side in the horizontal direction and a single ink supply pump and two recovery pumps are arranged will be described with reference to FIG. 1D. FIG. 1D is a diagram illustrating a configuration of the inkjet recording device where the two nozzles α and β are arranged side by side in the horizontal direction and the single ink supply pump and the two recovery pumps are arranged. The control of the print operation of FIG. 1D is the same as that of FIG. 1C, and thus, the description thereof is omitted. However, since the nozzles are arranged side by side in the horizontal direction, characters in the horizontal direction can be simultaneously printed.

Next, a print operation of an inkjet recording device where two nozzles α and β are arranged side by side in the vertical direction and two ink supply pumps and two recovery pumps are arranged will be described with reference to FIG. 1E. FIG. 1E illustrates a configuration of the inkjet recording device where the two nozzles α and β are arranged side by side in the vertical direction and the two ink supply pumps and the two ink recovery pumps are arranged. In the control of the print operation in FIG. 1E, at the time of ink supply from the ink container 25 to the nozzles, ink is supplied to the nozzle α by the supply pump 15*a*, and ink is supplied to the nozzle β by the supply pump 15*b*. At the time of ink recovery from the nozzles to the ink container 25, the ink of the nozzle α is recovered by the recovery pump 16*a*, and the ink of the nozzle β is recovered by the recovery pump 16*b*. In this case, since the ink supply passages for the nozzles α and β are different, the ink pressures at the time of supply also influence the print result.

Next, a group of print elements as an individual variation between nozzles and a change in print result at the time when print elements are changed will be described with reference to FIGS. 2A to 2C.

Figure 2A:
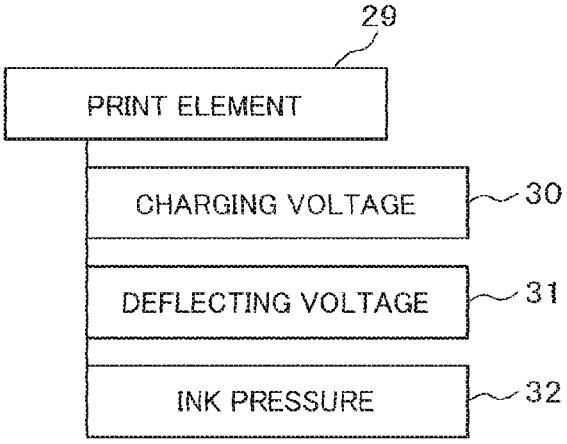
FIG. 2A illustrates a group of print elements which is regarded as an individual variation between nozzles.

FIG. 2A illustrates a group of print elements. Among the print elements 29, a charging voltage 30 with which the ink particles are charged, a deflecting voltage 31 which is applied to the charged ink particles, an ink pressure 32 exist and influence the print result of the inkjet recording device.

Figure 2B:
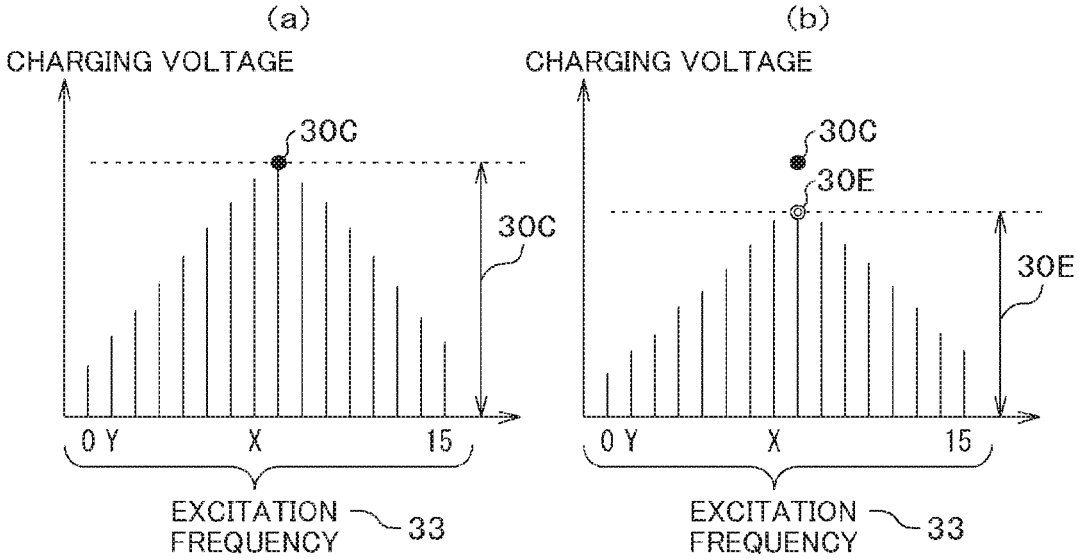
FIG. 2B illustrates a diagram for explaining a charging voltage in the group or print elements.

FIG. 2B illustrates an example of a change of the charging voltage. With respect to the charging voltage 30, in order to acquire a charging efficiency that is the maximum charge amount applied at the time of forming the ink particles 28*a* and 28*b*, the ink particles 28*a* and 28*b* are always charged with infinitesimal amounts, and the charge amounts of the gutters 19*a* and 19*h* are periodically measured in the state that the printing is not performed. At this time, the automatic phase maximum value at the time of measurement for every constant interval of the excitation frequency 33 is set to the charging voltage 30.

Since the charging voltage directly influences the charging efficiency, as illustrated in FIG. 2B, in a case where the current voltage 30E becomes smaller than the reference value 30C of the charging voltage 30, charged amounts of the ink particles 28*a* and 28*b* become small, so that characters may not be formed. Therefore, the level of the reference value 30C is necessary.

Figure 2C:
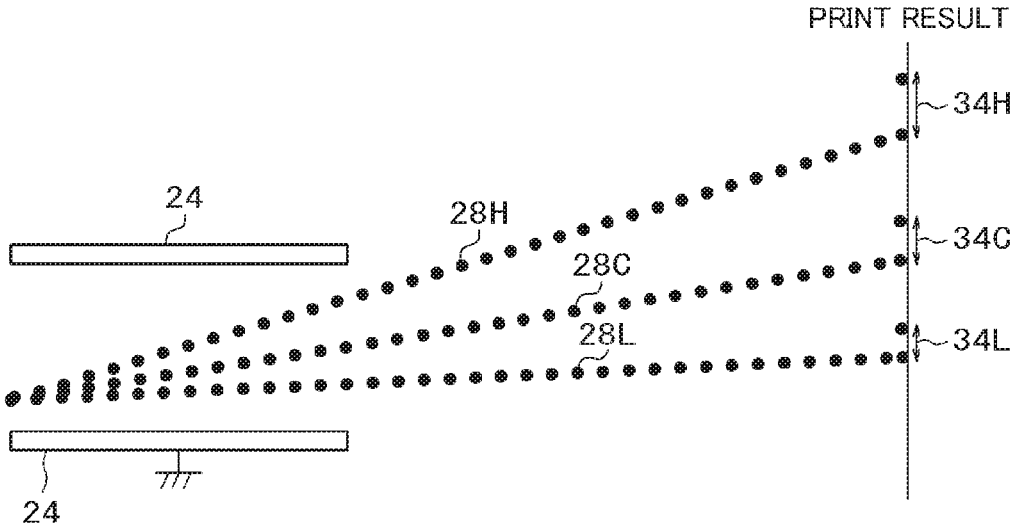
FIG. 2C illustrates a diagram for explaining a deflecting voltage in the group of print elements.

Next, FIG. 2C illustrates an example of a change in the deflecting voltage 31. The deflecting voltage 31 is a voltage value applied to the deflecting electrodes 24*a* and 24*b*, and the ink particles 28*a* and 28*b* are deflected when the ink particles pass through the deflecting electrodes 24*a* and 24*b* according to the charged amount. Therefore, if the deflecting voltage 31 is changed, the deflected amounts of the ink particles 28*a* and 28*b* having the same charged amounts as those in FIG. 2C are also changed within the deflecting electrodes 24*a* and 24*b*. Therefore, the landing positions 34 of the ink particles are changed.

More specifically, when the deflecting voltage 31 is increased, the current value 31H becomes larger than the reference value 31C of the deflecting voltage 31, so that the landing interval 34H of the ink particles 28H is widened in landing. When the deflecting voltage 31 is decreased, the current value 31L becomes smaller than the reference value 31C, so that the landing interval 34L of the ink particles 28L is narrowed in landing. In FIG. 2C, the landing interval 34C of the ink particles corresponds to the case of the reference value 31C.

In addition, the ink pressure 32 is a force for allowing the ink to be flowed from the ink container 25 toward the nozzles α and β and influences an ejecting speed of the ink particles when the ink particles 28 are ejected from the nozzles α and β. Therefore, if the ink pressure is changed, the size of the ink particles 28 is changed. More specifically, when the ink pressure 32 is increased, the nozzle ejecting speed of the ink particles 28 becomes high, so that the size of the ink particles 28 becomes small. When the ink pressure 32 is decreased, the nozzle ejecting speed of the ink particles 28 becomes low, so that the size of the ink particles 28 becomes large.

In this manner, the print result is changed according to the change in a group of print elements 29. When printing is performed by the inkjet recording device equipped with the twin nozzles, the operations with respect to the group of print elements 29 of the two nozzles need to be considered. As an example thereof, the problem is solved by employing the above-described configuration.

Next, the screen for inputting in the fine adjustment of the charging voltages, the deflecting voltages, and the ink pressures, and the setting values of the next print time of the nozzles will be described with reference to FIGS. 3A to 3C. Herein, the next printing indicates the case where printing is performed and the next printing is performed.

Figure 3A:
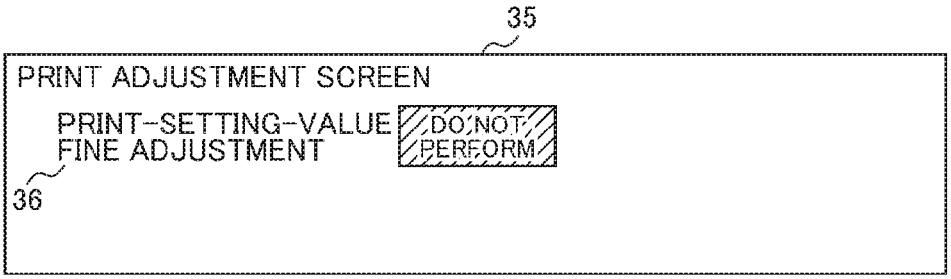
FIG. 3A illustrates a print adjustment screen at the time of setting "print-setting-value fine adjustment" of performing fine adjustment on setting values of a charging voltage, a deflecting voltage, and an ink pressure of the next print time of each of nozzles to "DO NOT PERFORM".

FIG. 3A illustrates a print adjustment screen 35 in a case where the item "print-setting-value fine adjustment" 36 is set to "DO NOT PERFORM". FIG. 3B illustrates a print adjustment screen 35A where the item "print-setting-value fine adjustment" 36 is set to "PERFORM", fine adjustment of the charging value and the deflecting voltage of the nozzle α is performed by inputting numeric values (points) corresponding to changed values, and similarly, fine adjustment of the charging voltage and the deflecting voltage of the nozzle β is performed by numeric values. FIG. 3C illustrates a print adjustment screen 35B where the item "print-setting-value fine adjustment" 36 is set to "PERFORM" and fine adjustment of the charging voltages, the deflecting voltages, and the ink pressures of the nozzles α and β is performed by inputting numeric values.

In FIG. 3A, if the item "print-setting-value fine adjustment" 36 is displayed in the print adjustment screen 35 and "DO NOT PERFORM" is set, as displayed in the screen 35, the other input items are not displayed. If the item is set to "PERFORM", the print adjustment screen 35 is switched like FIG. 3B or FIG. 35C. The print adjustment screen. 35A illustrated in FIG. 3B illustrates the case where the ink pressure 32 is not regarded as an individual variation between nozzles as illustrated in FIG. 1C. With respect to the selection items 37A of the nozzle α, only the charging voltage and the deflecting voltage can be changed, and similarly, with respect to the selection items 38A of the nozzle β, only the charging voltage and the deflecting voltage can be changed, and the fine adjustment can be performed.

Figure 3B:
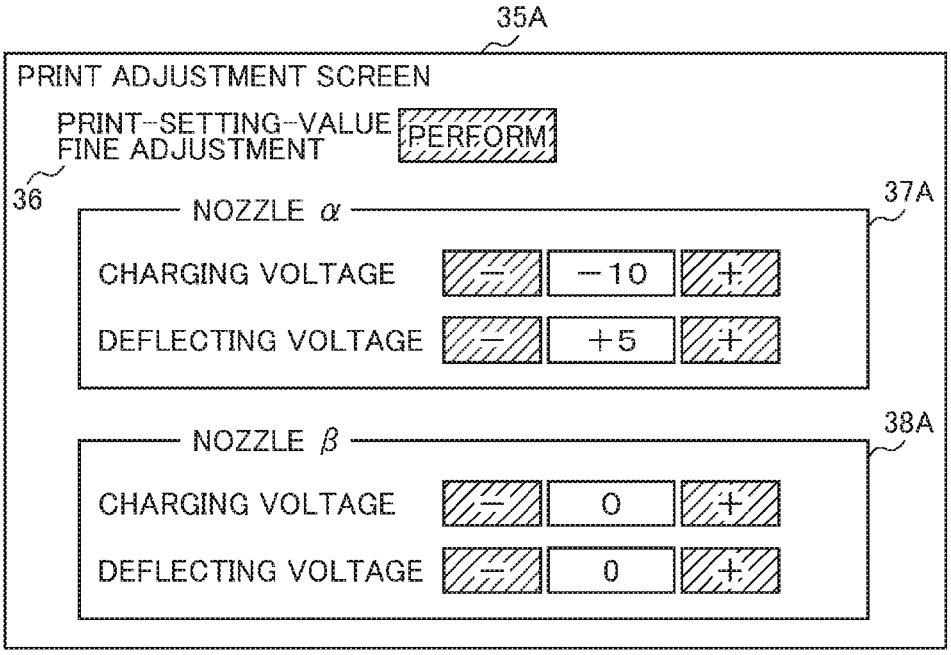
FIG. 3B illustrates a print adjustment screen at the time of setting "print-setting-value fine adjustment" of performing fine adjustment on setting values of a charging voltage, a deflecting voltage, and an ink pressure of the next print time of each of nozzles to "PERFORM".
Figure 3C:
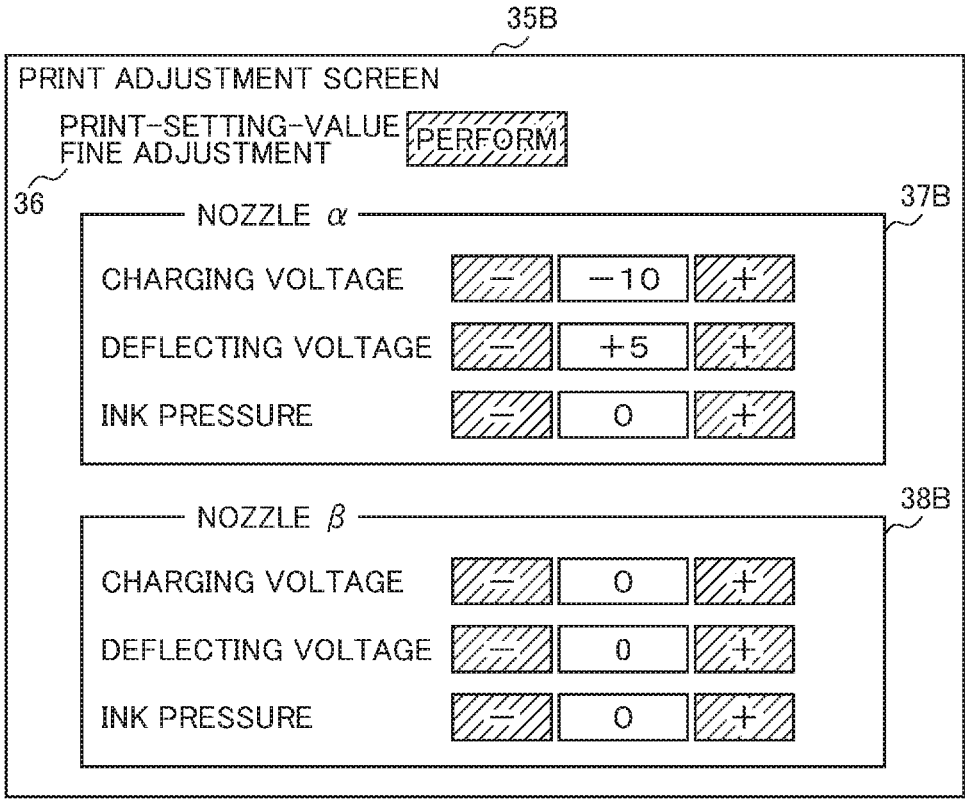
FIG. 3C illustrates a print adjustment screen at the time of setting "print-setting-value fine adjustment" of performing fine adjustment on setting values of a charging voltage, a deflecting voltage, and an ink pressure of the next print time of each of nozzles to "PERFORM".

In addition, FIG. 3C illustrates a screen 35B in a case where the ink pressure 32 regarded as an individual variation between nozzles as illustrated in FIG. 1E. In the nozzle α, the charging voltage, the deflecting voltage, and the ink pressure of the selection items 37B can be changed. Similarly, in the nozzle β, the charging voltage, the deflecting voltage, and the ink pressure of the selection items 38B can be changed. In addition, in the print adjustment screen, the to-be-changed object can be set to the nozzles α and β, and in the selection items 37A, 37B, 38A, and 38B, the fine adjustment direction and the fine adjustment amount from the current values can be input. Namely, when the input value is "+", the value obtained by increasing from the current value by the input value is used for the next print time; and when the input value is "−", the value obtained by decreasing from the current value by the input value is used for the next print time. When the input value is "0", the current value is used for the next print time as it is.

FIG. 3B illustrates that, with respect to the nozzle α, the charging voltage of "−10" and the deflecting voltage of "+5" are input so as to be changed, and with respect to the nozzle β, the input values thereof are "0" and is not changed. FIG. 3C illustrates that, with respect to the nozzle α, the charging voltage of "−10" and the deflecting voltage of "+5" are input so as to be changed, and the ink pressure is not changed; and with respect to the nozzle β, the charging voltage, the deflecting voltage, and the ink pressure are not changed. Herein, although the input numeric values (points) are set to numeric values corresponding to the voltage value and the pressure value, the numeric values themselves may be the voltage value or the pressure value.

Figure 4A:
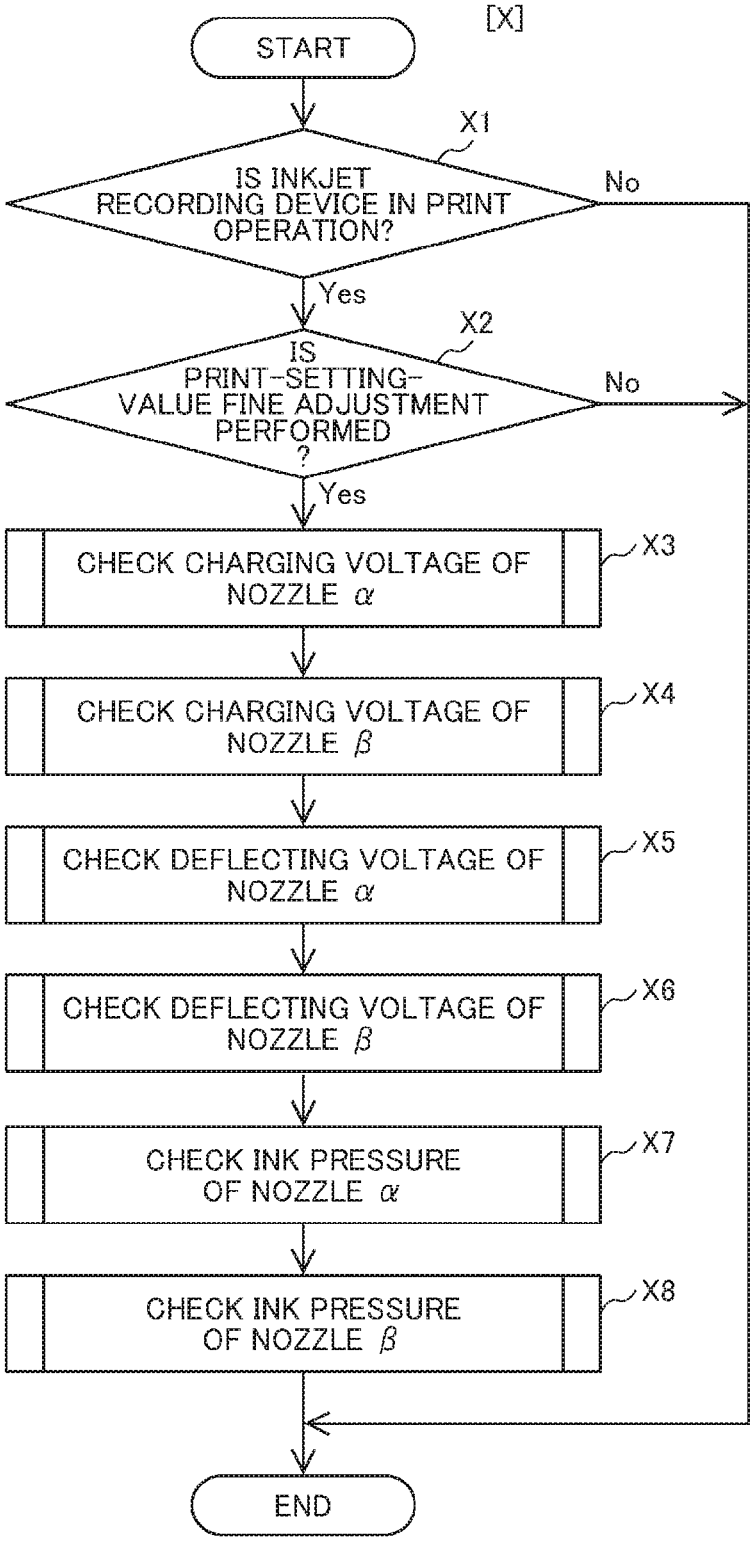
FIG. 4A illustrates setting value determination flowchart of a next print time.

Next, the charging voltages, the deflecting voltages, and the ink pressures of the nozzles described in FIGS. 3B to 3C and the flowchart [X] and subflowchart [sX] of the set value determination at the next print time will be described with reference to FIGS. 4A and 4B. FIG. 4A is the flowchart [X] of the set value determination of at the next print time when the item "print-setting-value fine adjustment" is set to "PERFORM" on the print adjustment screen 35, and FIG. 4B is the subflowchart [sX] thereof.

In the flowchart [X] of FIG. 4A, first, it is determined whether or not the inkjet recording device is in print operation (step X1). Next, in a case where the recording device is in print operation, it is determined whether or not print-setting-value fine adjustment is performed (step X2). If the result of determination is no in step X1 and step X2, the procedure is ended. In a case where the print-setting-value fine adjustment is performed (Yes), checking the charging voltage of the nozzle α is performed (step X3), and checking the charging voltage of the nozzle β is performed (step X4). Next, checking of the deflecting voltage of the nozzle α is performed (step X5), and checking of the deflecting voltage of the nozzle β is performed (step X6). In addition, checking the ink pressure of the nozzle α is performed (step X7), and next, checking the ink pressure of the nozzle β is performed (step X8).

By the above-described steps, the charging voltages, the deflecting voltages, and the ink pressures of the nozzles α and β are checked, and fine adjustment is performed on the setting value of each item of the next print time by using the subflowchart [sX]. In addition, with respect to the order of the checking of the charging voltage, the checking of the deflecting voltage, and the checking of the ink pressure of the above-described nozzles, the checking may be started from any one of the items.

Figure 4B:
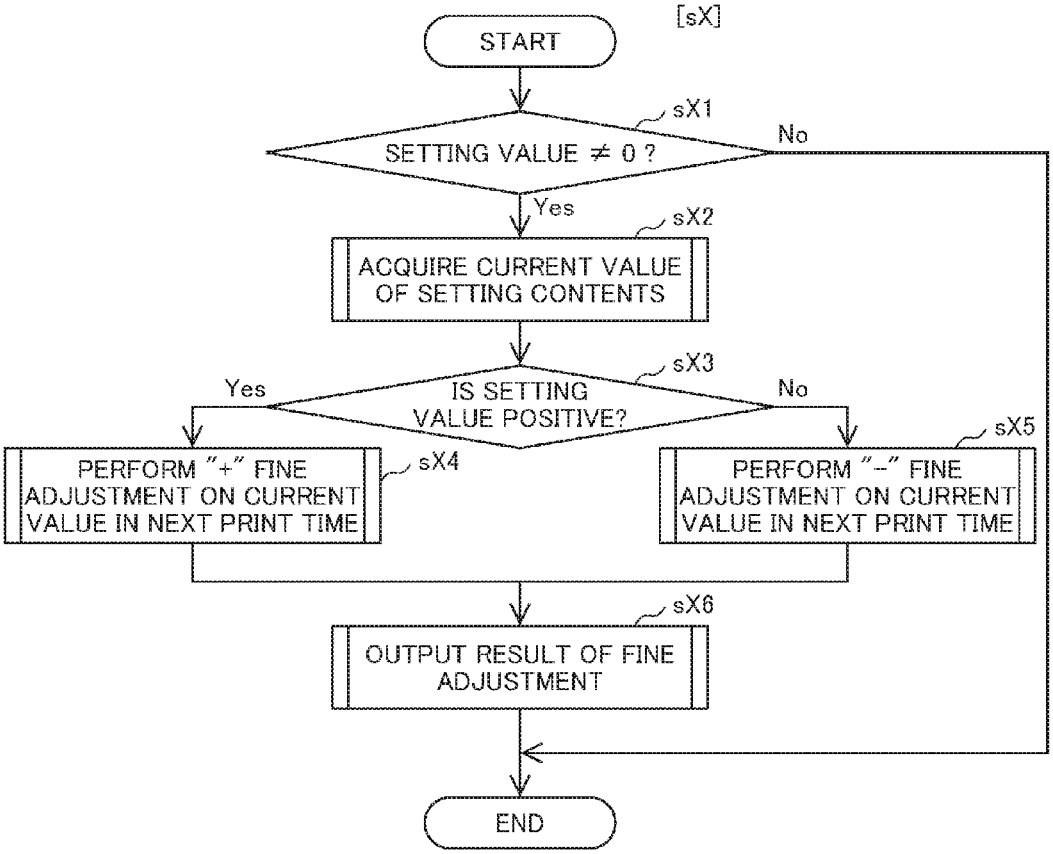
FIG. 4B illustrates a subflowchart of the setting value determination flowchart of the next print time.

In the subflowchart [sX] illustrated in FIG. 4B, first, when the "print-setting-value fine adjustment" illustrated in FIGS. 3B and 3C is set to "PERFORM", it is determined whether the setting values of the charging voltage, the deflecting voltage, and the ink pressure of the selection items 37A, 38A, 37B, and 38B are zero (step sX1). Next, when the setting values are not zero, the current value of each of the setting contents such as the charging voltage is acquired (step sX2). The method of acquiring the current values is the same as described above. Next, it is determined whether the setting value is positive or negative (step sX3). In a case where the setting value is positive, the value obtained by performing plus (+) fine adjustment on the current value is used as the value of the next print time (step sX4). In addition, in a case where the setting value is negative, the value obtained by performing minus (−) fine adjustment on the current value is used as the value of the next print time (step sX5). After the process of step sX4 or step sX5, the result of fine adjustment of the charging voltage and the like is output (step sX6), and the procedure is ended. By the above-described flowchart, it is possible to perform the fine adjustment on the charging voltage, the deflecting voltage, and the ink pressure.

Next, a "feedback process" of automatically correcting the setting values for fine adjustment of the charging voltage, the deflecting voltage, and the ink pressure of the next print time of each of the nozzles in the inkjet recording device will be described with reference to FIGS. 5A to 5D and FIGS. 6A and 6B. The "feedback process" denotes a function of automatically changing the setting values of the charging voltage, the deflecting voltage, and the ink pressure of the next print time according to designated reference values. The feedback process is used together with fine adjustment technique to obtain a better printing result.

Herein, as the method of setting the reference values in the "feedback process", two methods of (1) a "pre-setting method" of performing a test print in advance and setting the setting values thereof to the reference values and (2) a "designated nozzle following method" of designating a nozzle with reference values in advance and setting the print setting value of the previous time to the reference values will be described.

Figure 5A:
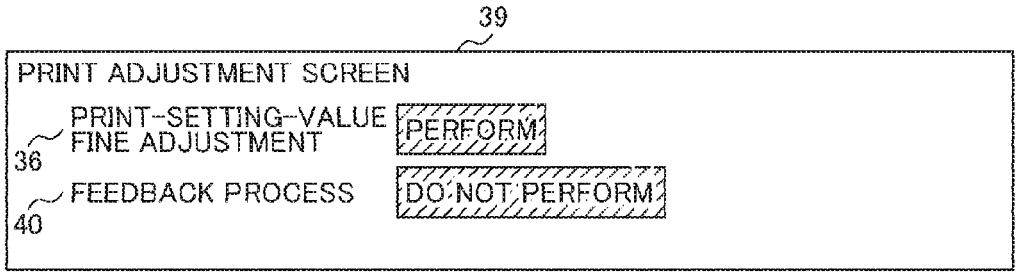
FIG. 5A illustrates a print adjustment screen at the time of setting "print-setting-value fine adjustment" of performing fine adjustment on the setting values of the charging voltage, the deflecting voltage, and the ink pressure of the next print time of each of nozzles to "PERFORM" and setting a "feedback process" to "DO NOT PERFORM".

FIGS. 5A to 5D illustrate print adjustment screens of setting whether or not to perform the "feedback process". In FIG. 5A, a key or button of setting whether to set the item "print-setting-value fine adjustment" 36 to "PERFORM" or "DO NOT PERFORM" exists on a print adjustment screen 39. If the "PERFORM" is set, a key or button of setting whether to set the "feedback process" 40 to "PERFORM" or "DO NOT PERFORM" is displayed. FIG. 5A illustrates the state that the "print-setting-value fine adjustment" is set to "PERFORM" and the "feedback process" is set to "DO NOT PERFORM".

Figure 5B:
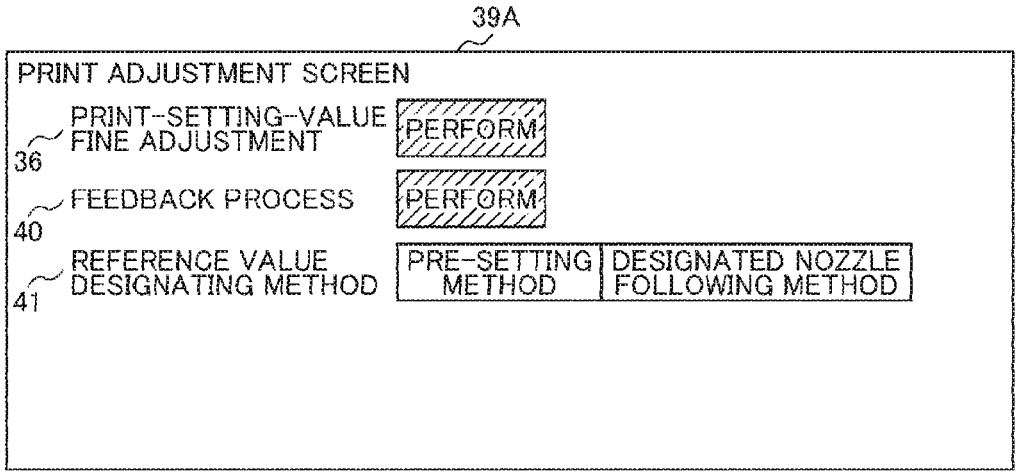
FIG. 5B illustrates a print adjustment screen at the time of setting "print-setting-value fine adjustment" of performing fine adjustment on the setting values of the charging voltage, the deflecting voltage, and the ink pressure of the next print time of each of nozzles to "PERFORM" and setting a "feedback process" to "PERFORM" and at the time of displaying a "reference value designating method".

In addition, FIG. 5B illustrates a print adjustment screen 39A where, if the "print-setting-value fine adjustment" 36 is set to "PERFORM" and the "feedback process" 40 is set to "PERFORM", the item "reference value designating method" is displayed on the resulting screen, the "pre-setting method" and the "designated nozzle following method" of the contents of the "reference value designating method" are displayed, and a screen of selecting whether to select the "pre-setting method" or the "designated nozzle following method" is displayed.

Figure 5C:
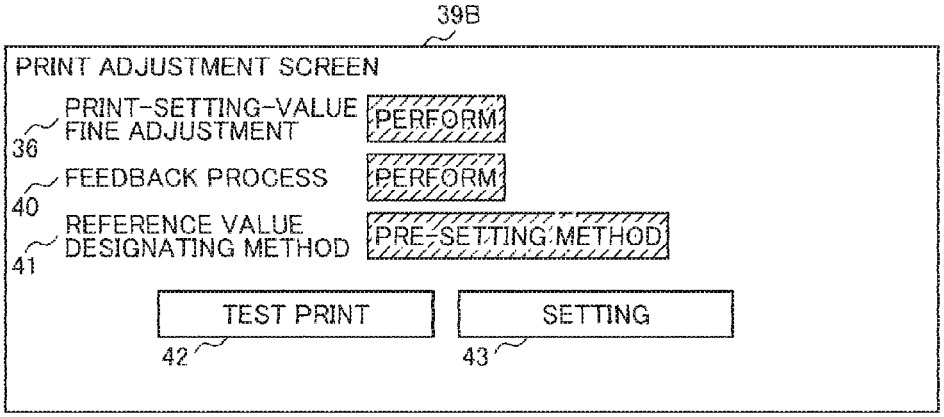
FIG. 5C illustrates a print adjustment screen at the time of setting "print-setting-value fine adjustment" of performing fine adjustment on the setting values of the charging voltage, the deflecting voltage, and the ink pressure of the next print time of each of nozzles to "PERFORM" and setting a "feedback process" to "PERFORM" and at the time of setting a "reference value designating method" to a "pre-setting method".

In addition, FIG. 5C illustrates a print adjustment screen 39B in that state that, if the "print-setting-value fine adjustment" 36 is set to "PERFORM", the "feedback process" 40 is set to "PERFORM", and the "reference value designating method" 41 is set to the "pre-setting method", keys or buttons of the "test print" 42 and the "setting" 43 are displayed. Every time when the button of the "test print" is pressed, the test print is performed by using the current print data. The test print is performed by finely changing the charging voltage, the deflecting voltage, and the ink pressure for every print.

In addition, the button of the "setting" 43 sets the setting values of the charging voltage, the deflecting voltage, and the ink pressure at the time of performing the test print by the button of the "test print" 42 to the reference values in the next print time.

Figure 5D:
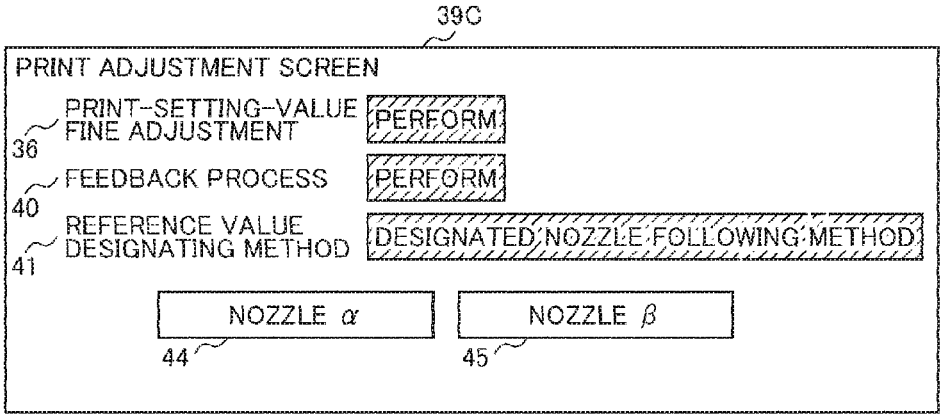
FIG. 5D illustrates a print adjustment screen at the time of setting "print-setting-value fine adjustment" of performing fine adjustment on the setting values of the charging voltage, the deflecting voltage, and the ink pressure of the next print time of each of nozzles to "PERFORM" and setting a "feedback process" to "PERFORM" and at the time of setting a "reference value designating method" to a "designated nozzle following method".

In addition, FIG. 5D illustrates a print adjustment screen 39C in the state that, if the "print-setting-value fine adjustment" 36 is set to "PERFORM", the "feedback process" 40 is set to "PERFORM", and the "reference value designating method" 41 is set to the "designated nozzle following method", a key or button of the "nozzle α" 44 and a key or button of the "nozzle β" 45 are displayed.

The button of the "nozzle α" 44 or the button of the "nozzle β" 45 can designate the nozzle with the reference values of the charging voltage, the deflecting voltage, and the ink pressure, and the current values of the designated nozzle are set as the reference values in the next print time.

Next, a determination flowchart. [Y] for the charging voltage, the deflecting voltage, and the ink pressure at the time of performing the "feedback process" and an entire flowchart [Z] at the time of performing the "feedback process" will be described with reference to FIGS. 6A and 6B.

Figure 6A:
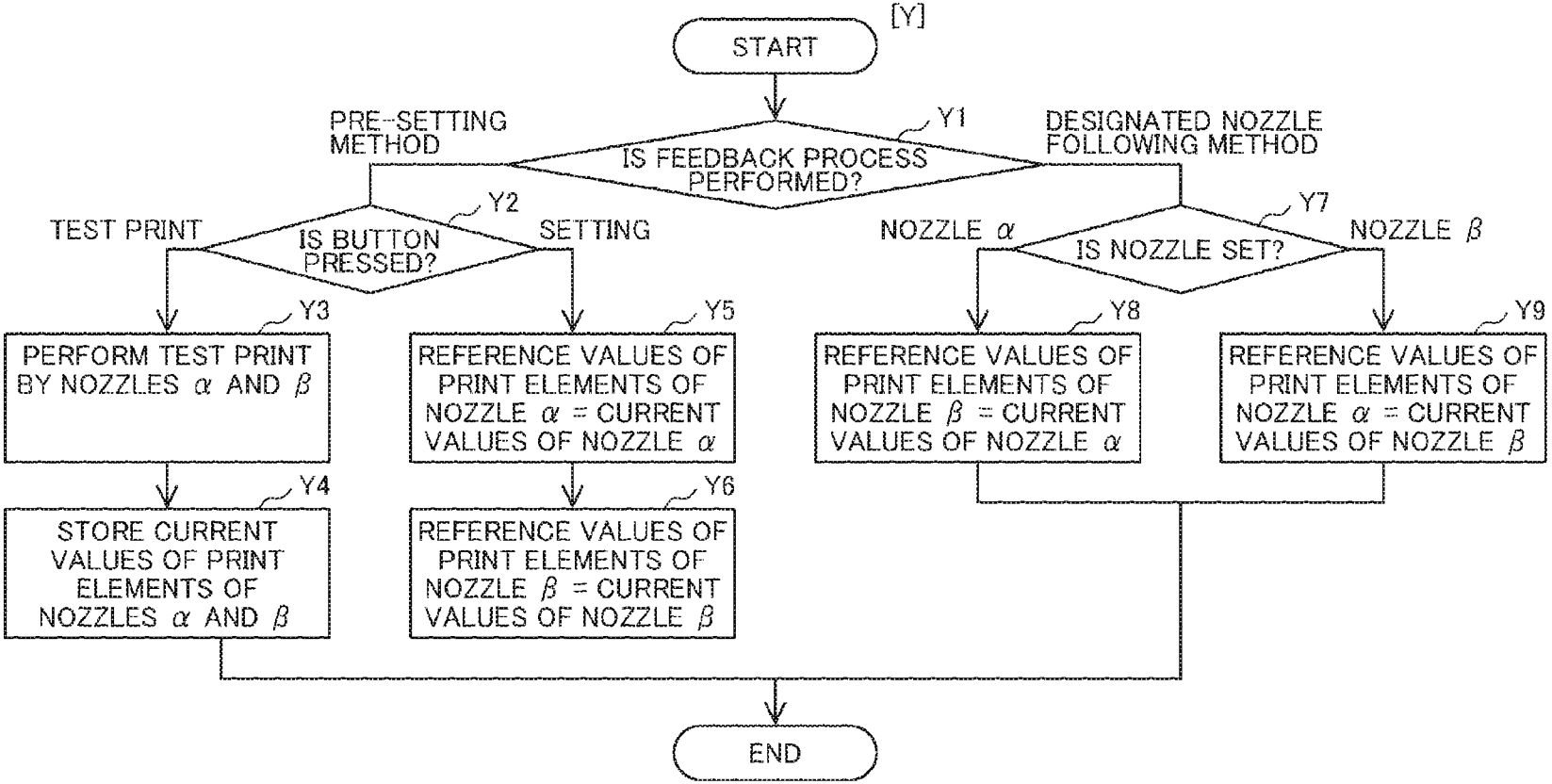
FIG. 6A illustrates a determination flowchart for the charging voltage, the deflecting voltage, and the ink pressure at the time of the "feedback process".

FIG. 6A illustrates the flowchart [Y]. In the flowchart [Y], first, it is determined by the feedback process whether the "reference value designating method" 41 is a "pre-setting method" or a "designated nozzle following method" (step Y1). Next, when the "pre-setting method" is set, it is determined whether the pressed button is the button of the test print 42 or the button of the setting 43 (step Y2). In a case where the button of the test print 42 is pressed, the test print is performed by the nozzles α and β (step Y3), the current values of the charging voltage, the deflecting voltage, and the ink pressure of each of the nozzles α and β are stored (step Y4), and the procedure is ended. In addition, in a case where the button of the setting 43 is pressed, the reference values of the charging voltage, the deflecting voltage, and the ink pressure of the nozzle α are set to the values of the charging voltage, the deflecting voltage, and the ink pressure at the time of performing the to print when the button of the test print 42 is pressed (step Y5). In addition, similarly, the reference values of the charging voltage, the deflecting voltage, and the ink pressure of the nozzle β are set to the values of the charging voltage, the deflecting voltage, and the ink pressure at the time of performing the test print when the button of the test print 42 is pressed (step Y6), and the procedure is ended.

Next, when the "designated nozzle following method" is set to the "reference value designating method" 41, it is determined whether the button of the nozzle α 44 or the button of the nozzle β 45 is pressed (step Y7). In a case where the button of the nozzle α 44 is pressed, the reference values of the charging voltage, the deflecting voltage, and the ink pressure of the nozzle β are set to the current values of the nozzle α (step Y8). In a case where the button of the nozzle β 45 is pressed, the reference values of the charging voltage, the deflecting voltage, and the ink pressure of the nozzle α are set to the current values of the nozzle β (step Y9), and the procedure is ended.

Figure 6B:
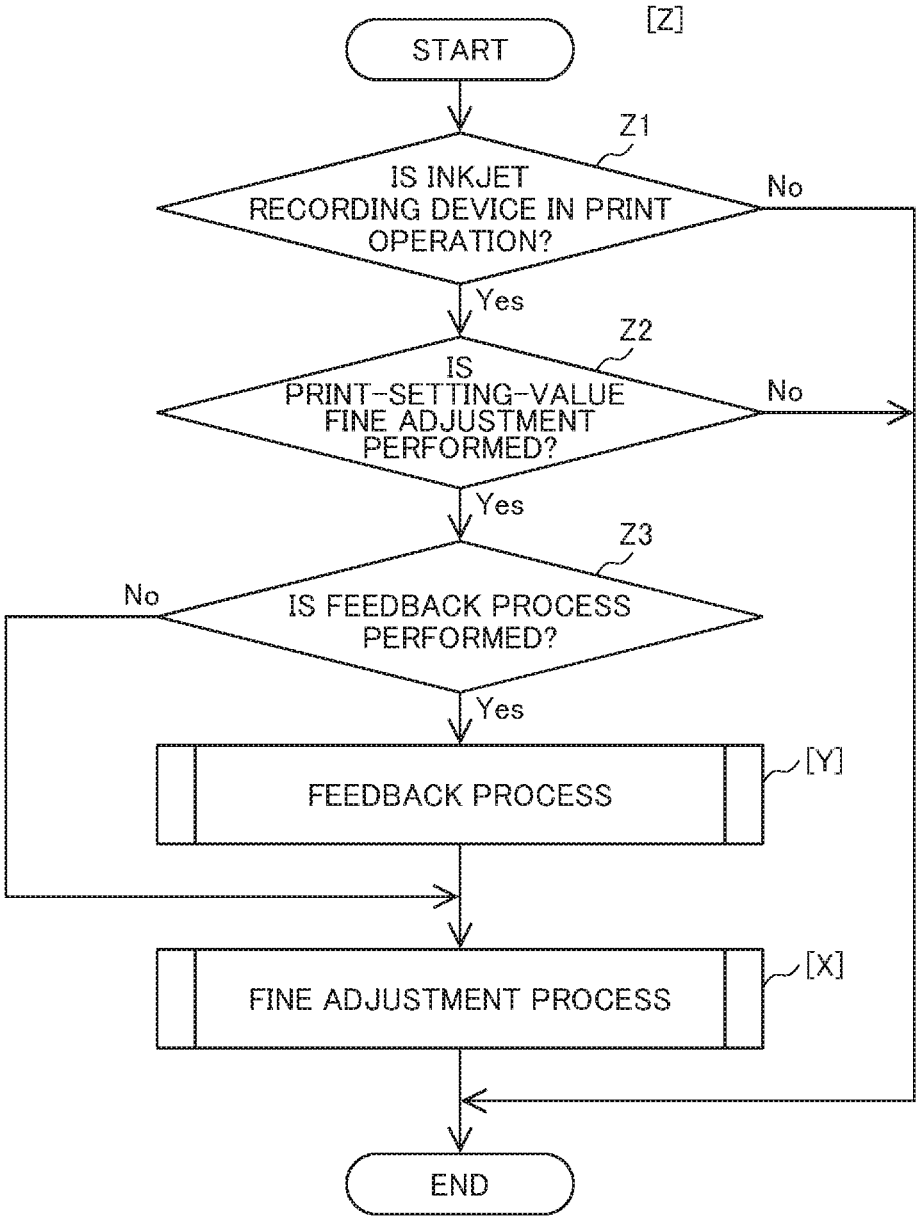
FIG. 6B illustrates an entire flowchart at the time of performing the "feedback process".

Next, in the entire flowchart [Z] of the feedback process illustrated in FIG. 6B, first, it is determined whether or not the inkjet recording device is in print operation (step Z1). Next, if the recording device is in print operation, it is determined whether or not the print-setting-value fine adjustment is performed (step Z2). If the print-setting-value fine adjustment is selected to be performed, it is determined whether or not the feedback process is performed (step Z3). In addition, if the recording device is not in print operation, the procedure is ended. If the print-setting-value fine adjustment is selected not to be performed, the procedure is ended. If the feedback process is determined to performed, the feedback process is performed (step [Y]), after that, the fine adjustment process is performed (step [X]), and the procedure is ended. If the feedback process is determined not to be performed, the fine adjustment process of step [X] is performed, and the procedure is ended.

In the above-described embodied configurations, particularly, the inkjet recording device equipped with the twin nozzles is described. However, in an inkjet recording device equipped with multi-nozzles including three or more nozzles, since print elements individually exist for every nozzle, the present invention can be applied to be effective. In addition, similarly, even though the nozzles are arranged in any one of the vertical direction, the horizontal direction, and a slanted direction, since the arrangement direction does not influence the print elements, the present invention is effective.

Heretofore, the present invention can obtain an effect of sustaining print quality without depending on the number of nozzle and arrangement positions of the nozzles, and the present invention is not limited to the all configurations described above.

REFERENCE SIGNS LIST

1 Inkjet recording device main body
2 Print head
3, 8 Display device
4 Conduit
5 MPU
6 RAM
7 ROM
9 Panel interface
10 Panel
11 Print material detection circuit
12 Print material sensor
13 External signal detection circuit
14 Electromagnetic valve
15 Supply pump
16*a*, 16*b* Recovery pump
17*a*, 17*b* Pressure sensor
18*a*, 18*b* APH (automatic phase) detection circuit
19*a*, 19*b* Gutter
20*a*, 20*b* Excitation frequency generation circuit
α, β Nozzle
21*a*, 21*b* Character signal generation circuit
22*a*, 22*b* Charging electrode
23*a*, 23*h* Deflecting voltage generation circuit
24, 24*a*, 24*b* Deflecting electrode
100 Bus
25 Ink container
26 Transport line
27 Print material (product)
28*a*, 28*b* Ink particles
29 Group of print elements
30 Charging voltage
31 Deflecting voltage
32 Ink pressure
33 Excitation frequency
34 ink particles landing interval
35, 39 Print adjustment screen
36 Item "print-setting-value fine adjustment"
37 Setting inputting portion of nozzle α
38 Setting inputting portion of nozzle β
40 Item "feedback process"
41 Item "reference value designating method"
42 Button "test print"
43 Button "setting"
44 Button "nozzle α"
45 Button "nozzle β"

The invention claimed is:

1. An inkjet recording device having a plurality of print configurations including nozzles which eject ink to form ink particles, charging electrodes which apply charging voltages to the ink particles to charge the ink particles, deflecting electrodes which deflect the charged ink particles, and a gutter which recovers the ink particles which are not used for printing, the inkjet recording device comprising a control unit which independently performs print control on the plurality of print configurations, wherein the control unit includes an input unit which can periodically check current values of print elements of each of the print configurations and an output unit which can change print elements of a next print time, and wherein the control unit adjusts each of the nozzles for each print so that a charging voltage, a deflecting voltage, and an ink pressure of a next print time are close to reference values.

2. The inkjet recording device according to claim 1, further comprising:

an input unit which can set input items for individually performing fine adjustment on the charging voltage, the deflecting voltage, and the ink pressure of the next print time; and a memory which stores contents input by the input unit, wherein setting values of the charging voltage, the deflecting voltage, and the ink pressure are changed according to the input contents.

3. The inkjet recording device according to claim 1, further comprising:

an input unit which can select whether or not to perform a control method of automatically correcting setting values of the charging voltage, the deflecting voltage, and the ink pressure of the next print time of each of the nozzles;

an input unit which can select a method for setting the reference values; and a memory which stores input contents, wherein the setting values of the charging voltage, the deflecting voltage, and the ink pressure of the next print time of each of the nozzles are automatically corrected according to the method selected in the setting.

4. The inkjet recording device according to claim 3, wherein in the input unit which can select the method for setting the reference values, a first method of performing test print in advance and using setting values at this time as the reference values and a second method of designating a nozzle with reference values in advance and using print setting values of the previous time as the reference values can be selected.

* * * * *